United States Patent [19]

Carter et al.

[11] 4,421,031

[45] Dec. 20, 1983

[54] PERCUSSION FUSE FOR TRAINING PROJECTILES

[75] Inventors: Harry R. Carter; Randall R. Carter, both of Moscow, Pa.

[73] Assignee: Pocal Industries, Inc., Moscow, Pa.

[21] Appl. No.: 259,542

[22] Filed: May 1, 1981

[51] Int. Cl.[3] ..... F42C 15/24

[52] U.S. Cl. ..... 102/252; 102/222

[58] Field of Search ..... 102/234, 221, 222, 235, 102/247-253, 258-261, 265, 272

[56] References Cited

U.S. PATENT DOCUMENTS

| | | | |
|---|---|---|---|
| 775,861 | 11/1904 | Semple | 102/252 |
| 1,375,466 | 4/1921 | Ragsdale | 102/252 |
| 1,861,521 | 6/1932 | Brandt | 102/232 |
| 2,118,062 | 5/1938 | Woodberry | 102/252 X |
| 2,243,621 | 5/1941 | Denoix | 102/253 |
| 2,404,135 | 7/1946 | Kiang | 102/252 |
| 2,821,925 | 2/1958 | Varaud | 102/249 |
| 2,845,866 | 8/1958 | Jasse | 102/253 |
| 2,870,713 | 1/1959 | Saloranta et al. | 102/251 |
| 2,938,463 | 5/1960 | Jasse | 102/253 X |
| 2,984,184 | 5/1961 | Cetre | 102/249 |
| 2,999,461 | 9/1961 | Apotheloz et al. | 102/253 |
| 3,782,289 | 1/1974 | Bruno | 102/250 |
| 4,036,145 | 7/1977 | Luebbers | 102/247 |
| 4,316,414 | 2/1982 | Hermanson | 102/253 X |

FOREIGN PATENT DOCUMENTS

| | | | |
|---|---|---|---|
| 208267 | 8/1959 | Austria | 102/253 |
| 705507 | 3/1941 | Fed. Rep. of Germany | 102/252 |
| 1081355 | 5/1960 | Fed. Rep. of Germany | 102/253 |
| 2709396 | 3/1977 | Fed. Rep. of Germany | 102/259 |
| 255136 | 6/1948 | Switzerland | 102/253 |

*Primary Examiner*—David H. Brown

*Attorney, Agent, or Firm*—Neil F. Markva

[57] ABSTRACT

A percussion fuse for artillery training ammunition such as mortar and howitzer projectiles. The training fuse assembly includes a body adapted for connection to a projectile body, a composition signal charge mountable within the fuse body and emitting report, smoke, and flash signals, and a striker unit for detonating the signal charge upon impact with a desired target. A combination safety system prevents premature detonation of the charge during handling, transportation, loading, and initial in-flight upward travel of the projectile. The fuse only becomes fully armed when the projectile reaches its terminal velocity and begins its downward flight toward the designated target. The armed fuse is highly sensitive and even upon impact with water will detonate in super quick fashion to discharge the entire signal before the projectile disappears below the surface of the water.

30 Claims, 4 Drawing Figures

PERCUSSION FUSE FOR TRAINING PROJECTILES

BACKGROUND AND SUMMARY OF THE INVENTION

This invention relates to a percussion fuse particularly useful with training ammunition such as mortar and howitzer training projectiles.

In fuse design it is necessary that the fuse function on the particular item of ammunition only at the time and under the circumstances desired, which for a mortar shell is at the time of impact with a desired target. Consequently, the fuse must be safe during handling, transportation, loading, and immediately after firing until the projectile has travelled a safe distance from the launching tube. In addition it is highly desirable that the fuse have an arming indicator which can be seen in the assembled round to shown clearly whether the fuse is safe or armed.

In the past fuses of various designs and safety mechanisms have be proposed. Typical prior designs are shown in U.S. Pat. Nos. 4,006,690; 3,995,556; 3,726,230; 3,375,786; 3,151,558; 2,870,713; 2,845,866; 2,359,752; 2,243,621; and 1,944,780. Prior training ammunition projectiles and fuses are also discussed in U.S. Army Training Manual TM9-1315-249-12 4 P, Chapter 1. However, none of these are satisfactory in cost and operation, particularly when applied to practice ammunition shells.

Accordingly, the primary object of this invention is to provide a novel, relatively simple, inexpensive detonating fuse assembly particularly useful with artillery training ammunition such as mortar shells which satisfies the safety requirements itemized above.

Another object resides in the provision of a novel fuse assembly comprising a slidable striker pin which upon impact with a target will detonate a composition signal charge. A safety system is incorporated within the fuse assembly and includes a slide pin which in the safe condition prevents contact of the striker pin with the signal charge, a set back pin which holds the slide pin in its safe position, and a manually removable pull pin which holds the set back pin in position. During handling and transportation these elements prevent detonation of the shell. Upon loading a shell in a launch tube, the pull pin is removed but the set back pin remains in safe position until after the shell is launched and is retracted only after a required inertial set back force, e.g. 700"G", is attained. The slider pin is then moved to an armed position out of the path of the striker. The safety system further includes a delay feature formed by a plurality of gravity responsive stop balls which in a safe position prevent the striker from contacting the charge during the initial upward flight of the projectile. Only after the projectile reaches its terminal velocity and begins its downward flight do the balls move under gravity to an armed position to fully arm the fuse at a safe distance from the launch tube as the shell approaches its target.

Still another object of the invention resides in the provision of a novel, totally integrated, self contained fuse assembly affording the above safety features and comprising a body, a striker unit slidably mounted within the body, a signal charge readily removably mounted within the body, and a detonating safety and delay system mounted within the body and permitting the fuse assembly to become fully armed only after predetermined in-flight conditions have been satisfied. Signal exhaust ports are provided in the body and, upon detonation of the charge, release signal, flash, and smoke report immediately at the nose end of the practice shell.

Yet another object of the invention resides in the provision of the above self-contained fuse assembly which may be made totally inert simply by removing from the body the signal charge which may be a standard shotgun shell loaded with a pyrotechnic that upon target impact will discharge a signal consisting of a loud report, a large volume of smoke, and a distinguishable flash.

Another object of the invention resides in the provision of the novel self-contained fuse assembly described above which is simple and low cost in manufacture, thus making it particularly useful for practice ammunition such as mortar shells. The assembly may be used with mortars fixed with various propelling charges and will properly function without any field adjustment for range, rotation, pressure, velocity, geology, temperature, or environment.

Still other objects and advantages of the invention will become apparent from reading the following detailed description of the invention wherein reference is made to the accompanying drawing in which like numerals indicate like elements.

DETAILED DESCRIPTION OF THE INVENTION

Figure 1:
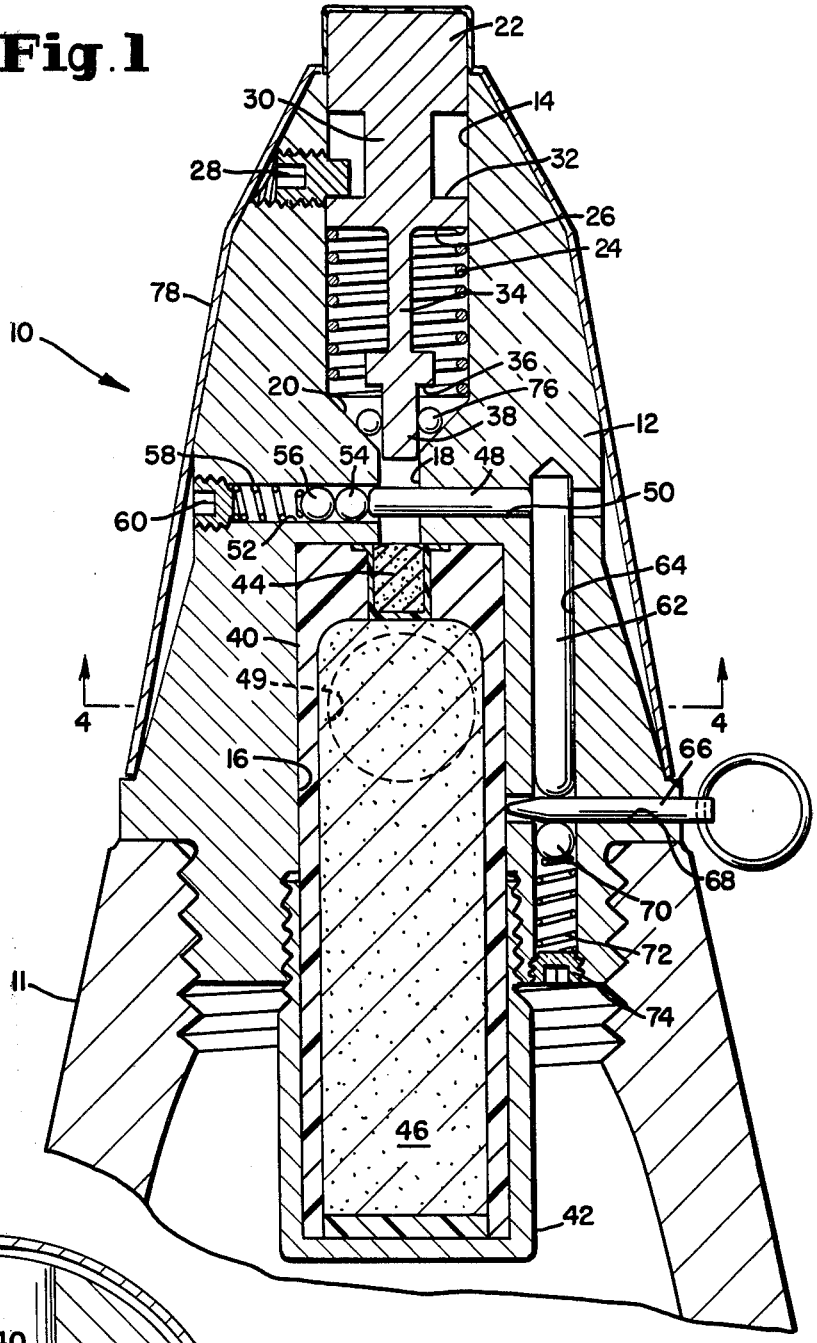
FIG. 1 is a partially sectioned fragmentary view of the novel fuse assembly of the invention illustrating all the elements in a safe position.

Referring now to FIG. 1, the novel fuse assembly 10 of the invention is especially useful with and connectible to a practice mortar shell 11 of the type shown in U.S. Pat. No. 4,109,579. Assembly 10 comprises an aluminum die cast or moded plastic body 12 formed along its axis with a forward bore section 14, an enlarged rearward bore section 16, a reduced central bore section 18, and a tapered bore section 20 leading from section 14 into section 18. An aluminum die cast striker pin 22 is slidably mounted within section 14 and is normally biased during flight in a forward direction by open-ended spring 24 acting between the bottom of section 14 and shoulder 26 on pin 22. Keeper pin 28 fits within an annular slot provided by reduced pin section 30 and abuts against shoulder 32 to hold pin 22 in body 12. Striker pin 22 is formed with a frangible reduced diameter section 34, a shoulder section 36, and a terminal section 38 which slidably fits within bore section 18.

A composition signal charge 40 is removably mounted within bore section 16 and is retained therein by cap 42 which may be threaded or otherwise suitably connected to the bottom of body 12. Charge 40 is preferably a standard shotgun shell with a primer 44 and loaded with a pyrotechnic 46 that upon detonation discharges a signal consisting of a loud report, a large volume of smoke, and a distinguishable flash visible, e.g., at 3000 meters.

Figure 4:
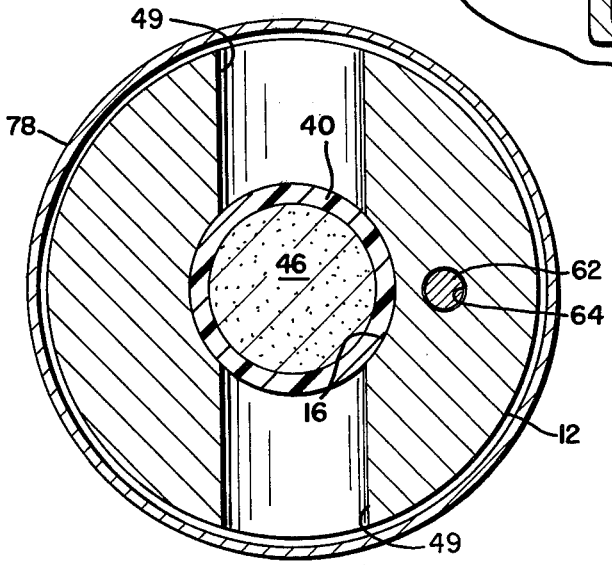
FIG. 4 is a sectional view taken along line 4—4 of FIG. 1 generally illustrating the signal exhaust ports within the body of the fuse.

In normal fashion upon impact of striker pin 22 with a designated target, pin 22 moves rearwardly to detonate charge 40. A smoke signal is then emitted through a plurality of exhaust ports 48 formed transversely through body 12 as shown in FIG. 4.

To protect against accidental or premature in-flight detonation of charge 40 by striker 22, fuse assembly 10 is provided with several safety mechanisms. A hardened steel slider stop pin 48 is slidably mounted within a transverse hole 50 and in its inward safe position shown in FIG. 1 extends through bore section 18 into the path of striker 22, thereby preventing striker section 38 from detonating primer 44. Located within transverse opening 52 is a loose firing ball 54 which is spring biased against the inner end of slider pin 48 by guide ball 56, spring 58, and stop 60. The diameter of firing ball 54 is greater than the diameter of hole 50. In the armed condition of the fuse (FIGS. 2 & 3) ball 54 rests in bore section 18 and becomes part of the firing mechanism between striker section 38 and primer 44.

A set-back pin 62 is slidably mounted within longitudinal opening 64 which perpendicularly intersects opening 50 and, in its forward safe position, engages its side face against the outer end of slider pin 48. A manually removable pull pin 66 is slidably mounted within a transverse hole 68 which intersects opening 64 so that pin 66 engages the rearward end of set-back pin 62 to mechanically hold it in its position of FIG. 1. Ball 70 is mounted within the rearward end of opening 64 and is resiliently biased by spring 72 and stop 74 against the rearward end of set-back pin 62 upon removal of pin 66. Spring 72 applies sufficient force against set-back pin 62 to hold it in its safe forward position until after the projectile is launched and a predetermined inertial force of, e.g. 700"G" retracts set-back pin 62.

A plurality of blocking detent balls 76 are loosely located between shoulder 36 of pin 22 and the wall of tapered bore section 20. In the nose-up position, gravity balls 76 are guided by tapered bore section 20 into surrounding relationship with pin section 38 and engage between shoulder section 36 and bore section 20 to limit the axial travel of pin 22 and prevent pin section 38 from striking ball 54. When fuse 10 assumes a nose-down position, balls 76 fall by gravity out of section 20, thereby having no affect on the travel of pin 22.

A snap-on molded plastic shield 78 is provided over body 12 for similation and weather protection purposes. Various dummy adjustable calibrations and settings may be incorporated in the shield to provide for more realistic training practices. The nose of striker 22 may be protected by a thin plastic film coating applied, for example, by a hot dip process. The coating would have no adverse affect on the function of the fuse.

From the description hereinabove it is clear that the novel fuse assembly 10 of the invention is totally safe with pull pin 66 in place as shown in FIG. 1. Set back pin 62 holds slider pin 48 in the path of striker 22 to prevent striker section 38 from causing detonation of primer 44. Thus, during assembly with pins 48, 62, and 66 in place as shown, charge 40 is readily inserted into body 12 without fear of accidental detonation by pin 22. In addition, during the handling and transportation of the fuse assembly, should it accidentally fall or be dropped on the nose of striker pin 22, pin section 38 would strike against the hardened slide pin 48 and cause the weakened reduced section 34 to buckle upon itself and thus prevent detonation.

Upon removal of pull pin 66 in preparation for loading shell 11 into a launcher, shell 11 must be accidentally dropped twice, once on its tail and once on its nose, to detonate charge 40 accidentally. The shell must first be dropped on its tail with sufficient impact to cause set-back pin 62 to be retracted against the force of spring 72, thereby causing spring 58 to push slide pin 48 out of the path of striker section 38 and firing ball 54 to become positioned in bore section 18. In a standard test set up, shell 11 must be dropped on its tail from a height over seven feet onto a heavy steel plate before this will occur.

However, merely dropping the shell on its tail will not detonate charge 40, since stop balls 76 resting in tapered bore section 20 will engage shoulder 36 to prevent striker section 38 from engaging firing ball 54. The fuse must be accidentally dropped a second time on its nose to cause balls 76 to roll out of the path of shoulder section 36 and permit section 38 to engage firing ball 54 to detonate primer 44. Thus, it is clear that one accidental drop will not detonate the fuse and this is an important safety feature.

Normal operation of fuse assembly 10 will now be described. As noted above initially all the components are positioned in the safe condition shown in FIG. 1. Upon removal of pull pin 66, ball 70 engages the rearward end of set-back pin 62 and the force of spring 72 keeps set-back pin 62 in its safe position as mortar shell 11 is loaded into a launch tube. Shell 11 is launched in an upward trajectory, usually at a 45° angle or more, and when a predetermined required inertial set back force, e.g. a 700"G" force caused by propulsion acts against set-back pin 62, pin 62 is retracted to its armed position shown in FIG. 2, thus releasing slider pin 48 and causing it to be pushed by spring 58 and balls 54 and 56 o its retracted armed position. Since fire ball 54 is larger in diameter than hole 50, ball 54 remains positioned in bore section 18 in functional alignment with striker section 38 and primer 44. The forward end of set-back pin 62 is held by spring 72 in frictional engagement with slider pin 48 to maintain pin 48 in its retracted position of FIG. 2.

Figure 2:
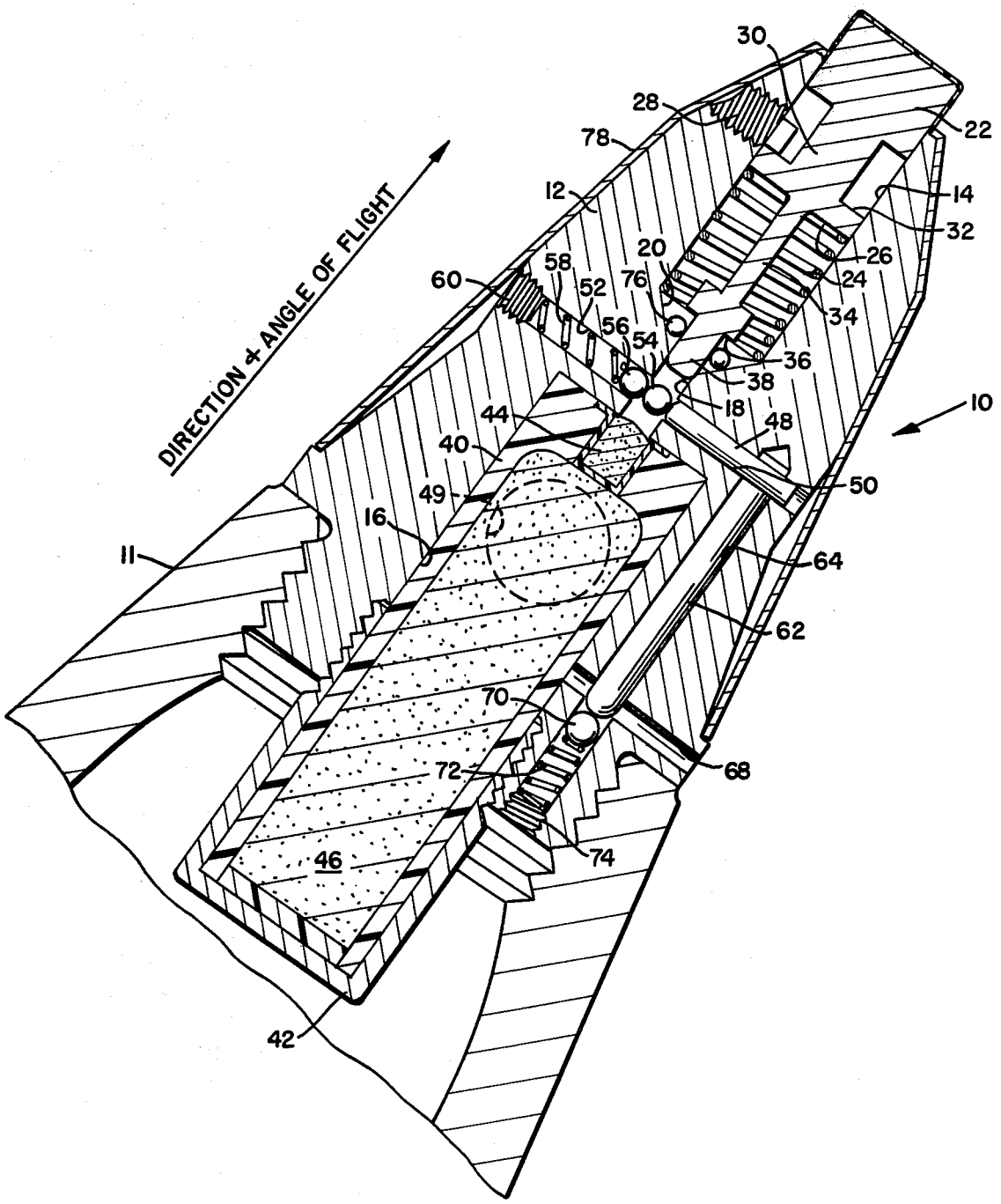
FIG. 2 is a fragmentary sectional view of the fuse in a partially armed condition immediately after launching a mortar shell as the shell travels in its upward trajectory.

As shown in FIG. 2, fuse 10 is still only in a partially armed condition and remains so during the upward trajectory flight of shell 11. Lock balls 76 under the force of gravity remain in bore section 20 in their safe blocking position relative to striker shoulder 36 and prevent striker pin 22 from moving a distance necessary to engage firing ball 54. Thus, the simple gravity responsive lock balls 76 function to prevent striker 22 from engaging slide pin 48 when the set-back pin 62 is armed. This provides a time delay feature during upward trajectory of the shell.

Figure 3:
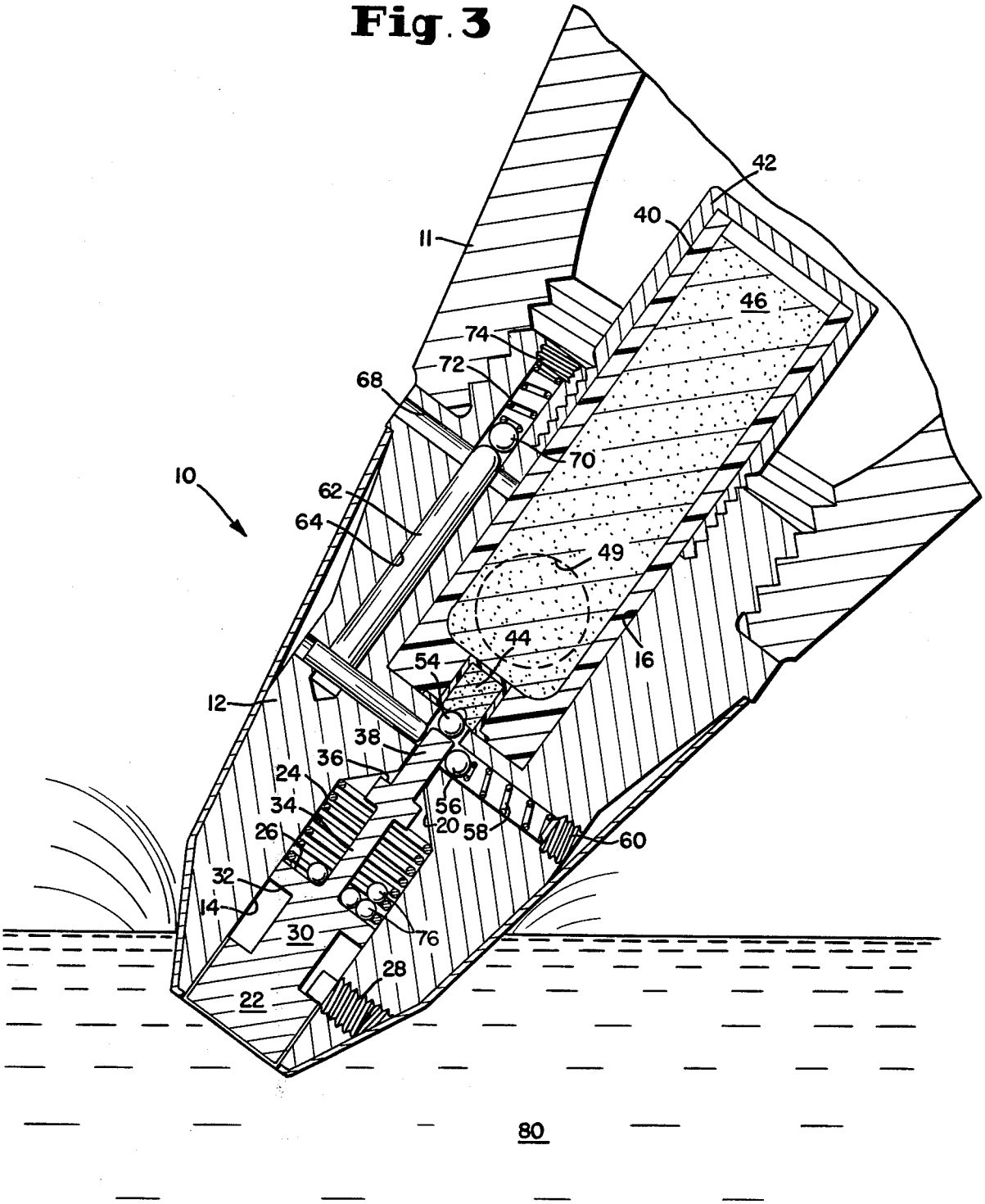
FIG. 3 is a fragmentary sectional view of the fuse in its fully armed condition as the shell travels in a downward trajectory toward its target.

Fuse 10 only becomes fully armed after shell 11 reaches its terminal velocity at a safe distance from the launch tube and begins a downward trajectory to strike its target, e.g. a body of water 80, as shown in FIG. 3. As fuse 10 assumes a nose-down position toward a target, under gravity balls 76 roll freely out of bore section 20 down against shoulder 26 out of the way of shoulder 36 as shown in FIG. 3. Thus upon impact with target 80, striker pin 22 is fully retracted so that pin section 38 drives fire ball 54 into rapid contact with primer 44 to detonate charge 40. The combination report, smoke, and flash signals are discharged instantaneously through ports 49, blowing off shield 78, to indicate to observation personnel the point of impact of shell 11.

Employing firing ball 54 as part of the firing mechanism reduces the distance that striker pin 22 must travel to detonate primer 44, thus greatly improving the sensitivity and speed of the fuse. In addition locating the signal discharge ports 49 within the body 12 in communication with the bore or chamber 16 housing charge 40 ensures that the signal is rapidly visibly discharged, e.g. even before the fuse disappears below the surface of water target 80.

The provision of ports 49 in body 12 are significant in another respect. Conventional training projectiles have a number of expensively drilled exhaust holes at the rear of the projectile. Fuse assembly 10 eliminates the need for such special holes.

From the foregoing description, it is clear that the simply constructed, inexpensive, reliable fuse assembly 10 of the invention provides all required operational safety features. In addition, the safe condition of the fuse shown in FIG. 1 is visible in several ways. Observing pull pin 66 in place indicates the fuse is totally safe. Likewise, observing the safe inward position of slider pin 48 through the outer end of hole 50 indicates the fuse is safe. By removing cap 42 and charge 40, one can see whether slider pin 48 is in its safe position.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fuse assembly for use in a projectile such as a mortar shell or the like, said assembly comprising:

(a) a body, (b) striker means generally axially movably mounted within said body between a forward safe position and a rearward charge detonating position in which it causes detonation of a charge, (c) slider means mounted within said body for movement between a safe position in which it prevents movement of said striker means to said detonating position and a retracted armed position in which it permits movement of said striker means to said detonating position, (d) set-back means mounted within said body in a normal safe position in which it retains said slider means in safe position, (e) said set-back means being movable from said safe position to an armed position in response to a predetermined inertial force acting thereupon following propulsion of said projectile to release said slider means for movement to its armed position, and (f) blocking means mounted within said body for movement in response to gravity to a safe position during upward trajectory flight of said projectile in which it prevents movement of said striker means to said detonating position and to an armed position during downward trajectory flight of said projectile in which it permits movement of said striker means to said detonating position upon impact with a target.

2. The fuse assembly according to claim 1 comprising manually operable stop means for retaining said set back means in its safe position.

3. The fuse assembly according to claim 1, said striker means comprising a striker pin slidable axially within said body, said slider means comprising a slider pin extending transversely when in its safe position into the axial path of movement of said striker pin, said striker pin having a frangible section which will buckle upon impact of said striker pin with said slider pin should said projectile be dropped accidentally on its nose.

4. The fuse assembly according to claim 1, said striker means comprising a striker pin having shoulder means formed thereon, said blocking means comprising ball means freely movable in response to gravity between a safe blocking position relative to said shoulder means during upward trajectory flight of a projectile and an armed unobstructing position relative to said shoulder means during downward trajectory flight of the projectile.

5. The fuse assembly according to claim 1 for use in a practice projectile comprising signal charge means mounted within said body in functional alignment with said striker means for detonation by said striker means upon impact of said striker means with a target.

6. The fuse assembly according to claim 5 comprising signal exhaust port means extending through said body in communication with said signal means.

7. The fuse assembly according to claim 1, said striker means comprising a striker pin slidable axially within said body, said slider means comprising a slider pin movable transversely with respect to the path of movement of said striker pin, biasing means urging said slider pin from its safe position to its armed position when said slider pin is released by said set back means, said biasing means including firing ball means which becomes positioned in the path of movement of said striker pin as said slider pin is moved to its armed position, whereby upon impact of said striker pin with a target said ball means is driven by said striker pin into contact with a charge.

8. The fuse assembly according to claim 7 for use in a practice projectile comprising signal charge means mounted within said body in functional alignment with said striker pin, said firing ball means being driven by said striker pin into said signal charge means upon impact of said striker pin with a target.

9. The fuse assembly according to claim 8 comprising signal exhaust port means extending through said body in communication with said signal charge means.

10. A fuse assembly for use in a projectile such as a mortar shell or the like, said assembly comprising:

(a) a body, (b) striker means mounted within said body for generally axial movement between a forward safe position and a rearward position in which it causes detonation of a charge;

(c) sliding stop means mounted within said body transversely with respect to the axial path of travel of said striker means and movable from a safe position in which it stops movement of said striker means to its charge detonating position to an armed position in which it permits such movement of said striker means;

(d) set-back means mounted within said body in a normal safe position in which it retains said sliding stop means in said safe position, (e) said set-back means being movable along a path generally parallel to the path of movement of said striker means from said safe position to an armed position in response to a predetermined inertial force following propulsion of the projectile to release said sliding stop means to its armed position; and (f) blocking means mounted within said body for movement in response to gravity from a safe position during upward trajectory flight of the projectile in which it prevents movement of said striker means to said detonating position and to an armed position during downward trajectory flight of the projectile in which it permits movement of said striker means to said detonating position upon impact of said striker means with a target.

11. The fuse assembly according to claim 10, said striker means comprising a striker pin having shoulder means formed thereon, said blocking means comprising ball means freely movable in response to gravity between a safe blocking position relative to said shoulder means during upward trajectory flight of the projectile and an armed unobstructing position relative to said shoulder means during downward trajectory flight of the projectile.

12. The fuse assembly according to claim 10 comprising manually removable stop means for retaining said set back means in its safe position during handling of the projectile.

13. The fuse assembly of claim 10 for use in a practice projectile comprising signal charge means mounted within said body in alignment with said striker means for detonation by said striker means upon impact of said striker means with a target.

14. The fuse assembly of claim 13 comprising signal exhaust port means extending through said body in communication with said signal charge means.

15. A fuse assembly for use in a practice projectile such as a mortar shell or the like, said assembly comprising:

(a) a body;

(b) signal charge means mounted in the rearward end of said body;

(c) striker means mounted within the forward end of said body;

(d) said striker means including a striker pin slidably mounted for generally axial movement between a forward safe position and a rearward detonating position in which it causes detonation of said charge, said striker pin having shoulder means formed thereon;

(e) a slidable stop pin mounted within said body transversely with respect to the axial path of travel of said striker pin and movable from a safe position in which it stops movement of said striker pin to its detonating position to an armed position in which it permits movement of said striker pin to its detonating position;

(f) set-back means comprising a slidable set-back pin mounted within said body in a normal safe position in which it retains said stop pin in said safe position;

(g) manually removable stop means normally holding said set-back pin in its safe position, (h) resilient biasing means for holding said set-back pin in its safe position after removal of said manual stop means during loading of the projectile in a launcher, (i) said set-back pin being movable along a path generally parallel to the path of movement of said striker pin from said safe position to an armed position in response to a predetermined inertial force following propulsion of the projectile to release said slidable stop pin for movement to its armed position; and (j) blocking ball means freely movable in response to gravity between a safe blocking position relative to said shoulder means during upward trajectory flight of the projectile in which it prevents movement of said striker pin to its detonating position and an armed unblocking position relative to said shoulder means during downward trajectory flight of the projectile in which it permits movement of said striker pin to its detonating position upon impact of said striker pin with a target.

16. The fuse assembly according to claim 15 comprising signal exhaust port means extending through said body in communication with signal charge means.

17. The fuse assembly of claim 15, said slidable stop pin when in its safe position extending transversely into the axial path of movement of said striker pin, and said striker pin having a frangible section which will buckle upon impact of said striker pin with said sliker pin should said projectile be dropped accidentally on its nose.

18. The fuse assembly according to claim 15 comprising biasing means urging said slidable stop pin from its safe position to its armed position when said stop pin is released by said set back pin, said biasing means including movable firing ball means which becomes positioned in the path of travel of said striker pin, whereby upon impact of said striker pin with a target said firing ball means is driven into contact with said signal charge means.

19. The fuse assembly according to claim 18 comprising signal exhaust port means extending through said body in communication with signal charge means.

20. A fuse assembly for use in a projectile such as a mortar shell or the like, said assembly comprising:

(a) a body, (b) charge means mounted in the rearward end of said body;

(c) striker means mounted within the forward end of said body and including a striker pin slidably mounted for generally axial movement between a forward safe position and a rearward detonating position in which it causes detonation of said charge means;

(d) a slidable stop pin mounted within said body transversely with respect to the axial path of travel of said striker pin, (e) biasing means urging said stop pin from a safe position to an armed position, (f) said stop pin in its safe position preventing movement of said striker pin to its detonating position and in its armed position permitting such movement; and (g) set-back means comprising a slidable set-back pin mounted within said body in a normal safe position in which it retains said stop pin in its safe position, resilient means biasing said set-back pin towards its safe position, (h) said set-back pin being movable along a path generally parallel to the path of movement of said striker pin from its safe position to an armed position in response to a predetermined inertial force following propulsion of the projectile to release said stop pin for movement to its armed position and thereby permit said striker pin to cause detonation of said charge means upon impact of said striker pin with a target, and (i) said biasing means including a movable firing ball which becomes positioned in the path of travel of said striker pin when said stop pin is released by said set back pin and moved to its armed position, whereby upon impact of said striker pin with a target said firing ball is driven into contact with said charge means.

21. The fuse assembly according to claim 20, said biasing means including spring means and a guide ball engaging and urging said firing ball into contact with the end of said stop pin.

22. The fuse assembly of claim 20, comprising exhaust port means in said body communicating with said charge means for exhausting a signal through said body.

23. The fuse assembly according to claim 20 comprising manually removable stop means normally holding said set-back pin in its safe position and removable upon loading the projectile into a launcher.

24. The fuse assembly according to claim 20, wherein said striker pin includes shoulder means formed thereon; and blocking ball means are freely movable in response to gravity between a safe blocking position relative to said shoulder means during upward trajectory flight of the projectile in which it prevents movement of said striker pin to its detonating position and an armed unblocking position in which it permits movement of said striker pin to its detonating position upon impact of said projectile with a target.

25. The fuse assembly according to claim 24, wherein said striker means includes open ended spring means, said blocking ball means being freely movable inside said open ended spring means.

26. The fuse assembly according to claim 24, comprising means for guiding said ball means into said safe blocking position with said shoulder means during upward trajectory flight of the projectile.

27. The fuse assembly according to claim 26, wherein said guiding means includes a tapered bore section in said body.

28. A fuse assembly for use in a projectile such as a mortar shell or the like, said assembly comprising:

(a) a body having a charge means, (b) striker means generally axially movably mounted within said body between a forward position and a rearward charge detonating position in which it causes detonation of the charge means, (c) stop means mounted within said body for movement between a safe position and a retracted armed position, and (d) means mounting a firing element to cause the firing element to move into the path of travel of the striker means while the striker means is in a forward armed position, (e) said firing element being driveable into contact with the charge means by the striker means when the striker means moves from a forward armed position to the rearward charge detonating position, (f) the stop means in its safe position prevents movement of the striker means to the detonating position and in the retracted armed position the stop means permits movement of the striker means to the detonating position, (g) the stop means includes a stop member and set-back means mounted within the body in a normal safe position in which it retains the stop member in a safe position, (h) said set-back means being movable to an armed position in response to a pre-determined inertial force, following propulsion of the projectile to release the stop member to an armed position.

29. The fuse assembly according to claim 28, wherein the firing element mounting means includes means for urging the firing element toward the path of travel of the striker means.

30. The fuse assembly according to claim 28 wherein the firing element is a ball and the firing element mounting means includes a spring which urges the ball toward the path of travel of the striker means.

* * * * *